US005926987A

United States Patent [19]

Novak

[11] Patent Number: 5,926,987

[45] Date of Patent: Jul. 27, 1999

[54] CARTRIDGE INDICATOR FOR FIREARMS

[76] Inventor: Peter Novak, 7181 Garfield Ave., Hungtington Beach, Calif. 92648

[21] Appl. No.: 08/907,721

[22] Filed: Aug. 8, 1997

[51] Int. Cl.[6] ..... F41A 9/53

[52] U.S. Cl. ..... 42/1.05; 42/1.01

[58] Field of Search ..... 42/1.01, 1.05

[56] References Cited

U.S. PATENT DOCUMENTS

| | | | |
|---|---|---|---|
| 385,360 | 7/1888 | Lefever | 42/40 |
| 891,438 | 6/1908 | Peard | 42/1.05 |
| 1,028,032 | 3/1912 | Krag | 89/140 |
| 1,219,896 | 3/1917 | Yanert | 42/1.05 |
| 1,395,455 | 11/1921 | Searle | 89/196 |
| 1,992,934 | 3/1935 | Bamberger | 42/1 |
| 2,145,328 | 1/1939 | Walther | 42/3 |
| 2,850,827 | 9/1956 | Luciani | 42/1 |
| 4,100,691 | 7/1978 | Wicklund | 42/1 D |
| 4,103,639 | 8/1978 | Otteson | 42/1 D |
| 4,483,088 | 11/1984 | Tussing | 42/1 D |
| 4,709,496 | 12/1987 | Johnson | 42/70.11 |
| 4,793,085 | 12/1988 | Surawski et al. | 42/84 |
| 5,052,139 | 10/1991 | Marzocco | 42/1.05 |
| 5,410,831 | 5/1995 | Felk | 42/25 |

*Primary Examiner*—Charles Jordan
*Assistant Examiner*—Meena Chelliah
*Attorney, Agent, or Firm*—Dennis W. Beech

[57] ABSTRACT

The cartridge indicator is a rod slidably mounted in a cavity in the breech slide of a firearm to allow checking for the presence of a cartridge in the chamber. The rod has a check end which protrudes out of the breech slide as biased by a spring at the chamber end of the rod in the cavity. The chamber end of the rod has attached a chamber pin which slides in a pin cavity in the breech slide. When the check end is pushed into the breech slide by the user, if the chamber has no cartridge, the chamber pin moves into the chamber and the check end is pushed into the breech slide thereby indicating an empty chamber. If the chamber pin encounters a cartridge, the check end can not be pushed into the breech slide.

6 Claims, 2 Drawing Sheets

CARTRIDGE INDICATOR FOR FIREARMS

BACKGROUND OF THE INVENTION

1. Field of the Invention

This invention relates to devices used to indicate the presence or absence of a cartridge in the chamber of a firearm. The new device provides a simple means to check for the presence of a cartridge or shell in the chamber without the need to open the chamber 2. Description of Related Art There are currently existing various apparatus to indicate the presence or absence of a cartridge in a firearm. In the simplest of cases an indicator may be mounted in a weapon breech slide or the barrel such that when a cartridge is present in the chamber the indicator is displaced outwardly at one end. This protruding end serves to indicate the presence of a cartridge.

In other disclosed designs the extractor for a weapon is modified such that when the shell of a cartridge is engaged a portion or element of the extractor is displaced to provide an indication of the presence of a cartridge. In some firearms there is provided a separate signal rod that is biased with a spring such that when a cartridge is present in the chamber the end of the signal rod is displaced rearward, for example, in the breech block, to protrude from the firearm and be visible. Still more complex mechanisms may involve displacement rods with lever arms and visible signal flag indicators.

All of these devices involve a signal indicator which is biased to be displaced when a cartridge is present in a firearm chamber. This provides for the operation of the cartridge indicator as a cartridge is loaded and extracted from the weapon and by its design it interacts as part of the loading/extraction operation. Because of this automatic feature as part of the loading/ extraction, the indicator is subject to wear, breakage and failure as it is continuously functioning as part of the firearm operation.

The present invention provides a cartridge indicator which does not interact with the cartridge as part of the loading/extraction operation of the firearm. Rather the cartridge indicator is biased by a spring such that it does not normally engage the cartridge. The user of the firearm presses a protruding rod or finger tab to push the indicator toward the chamber of the firearm. If no cartridge is present in the chamber the indicator may be pushed into the breech block of the weapon; however, if a cartridge is present, the indicator is prevented from full movement and thus indicates the presence of a cartridge.

SUMMARY OF THE INVENTION

One object of the present invention is to allow a check of the chamber of a firearm to determine whether there is a cartridge present therein without the need to open the chamber. Another object of this invention is the improvement of the useful life of the indicator as it is not automatically operable during the cartridge loading and extraction process.

In accordance with the description presented herein, other objectives of this invention will become apparent when the description and drawings are reviewed.

DESCRIPTION OF THE PREFERRED EMBODIMENT

The cartridge indicator comprises a rod mounted in the breech slide of a firearm approximately parallel to the longitudinal axis of the barrel. The rod has a chamber pin mounted such that it can protrude into the chamber in the absence of a cartridge. The rod is biased by a spring such as not to protrude from the breech block into the chamber except when pushed by the user.

Figure 1:
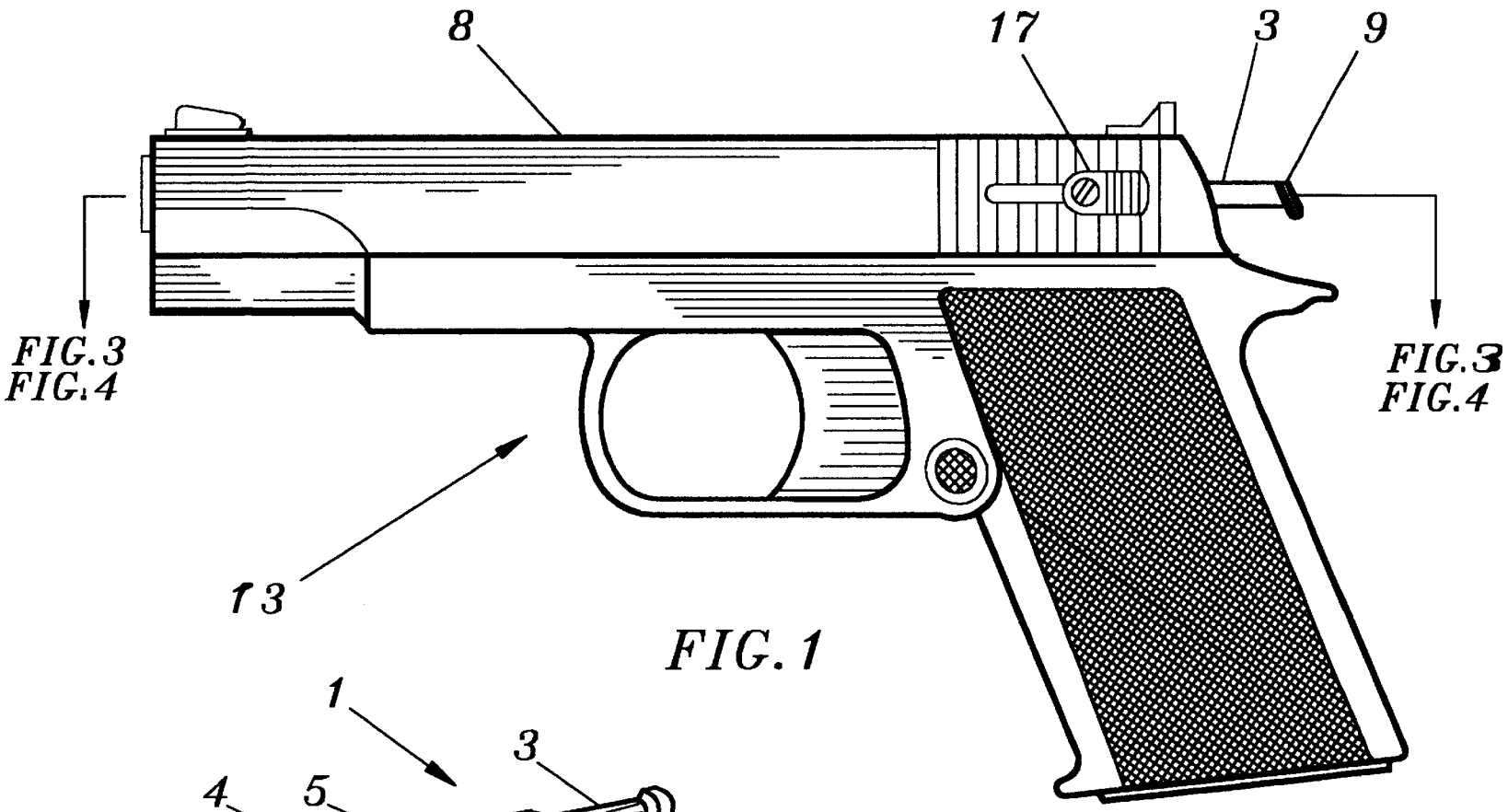
FIG. 1 illustrates is a side elevation view of an automatic firearm with cartridge indicator.
Figure 2:
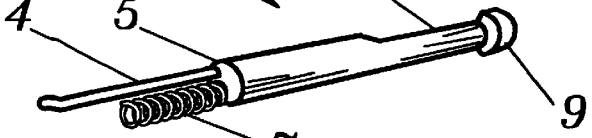
FIG. 2 illustrates a perspective view of the cartridge indicator.
Figure 3:
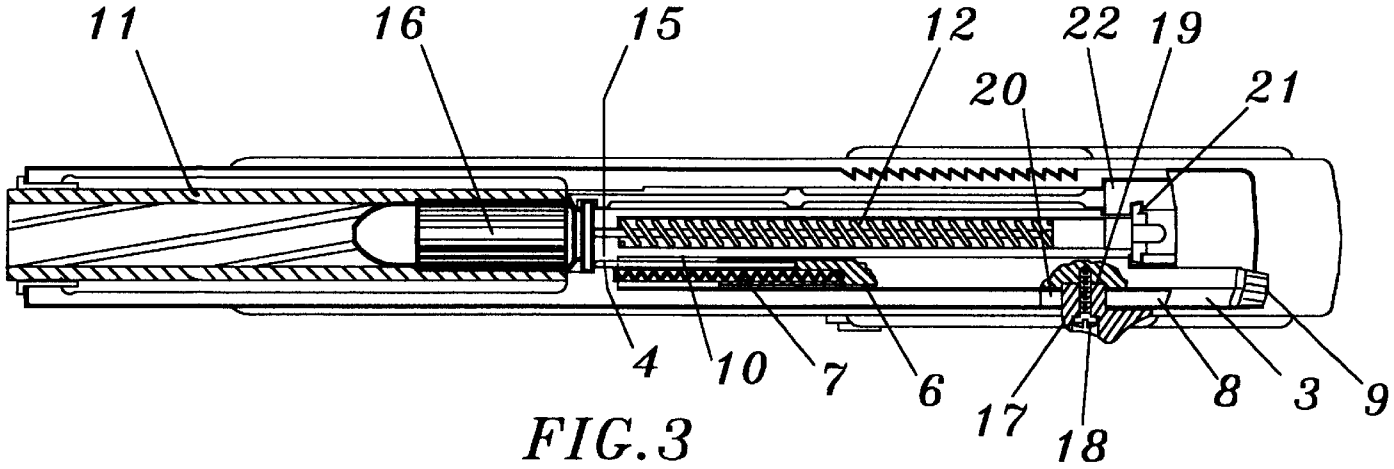
FIG. 3 illustrates a top sectional view of the firearm taken at A—A showing a cartridge in the chamber.
Figure 4:
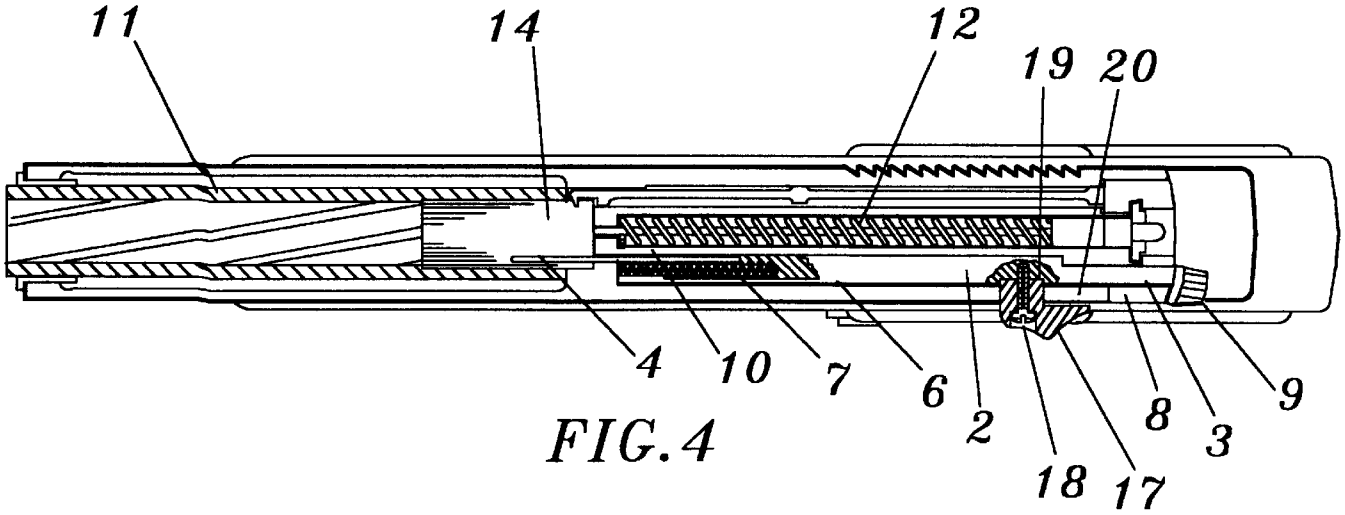
FIG. 4 illustrates a top sectional view of the firearm taken at A—A showing the cartridge indicator pushed into the firearm.

Referring to FIGS. 1 through 4, the cartridge indicator (1) comprises a rod (2) having a check end (3) and a chamber pin (4) attached at the chamber end (5). The rod (2) has a spring cavity (6) in the chamber end (5) with a spring (7) mounted therein. The check end (3) is flattened on one side as illustrated in FIG. 3 to retain the rod (2) in the breech slide (8). The firing pin stop (21) prevents the rod (2) from exiting the breech slide similar to the extractor (22). The check end (3) also has a tab (9) to limit how far into the breech slide (8) the rod (2) may be pushed.

The cartridge indicator (1) is slidably mounted in a cavity (10) oriented in the breech block (8) of the firearm (13) such that the cartridge indicator (1) moves approximately parallel to the longitudinal axis of the barrel (11). The cartridge indicator (1) may be in close proximity to the firing pin (12). The spring (7) biases the rod (2) toward the rear, away from the chamber (14), of the firearm (13). In this bias position the check end (3) protrudes from the rear of the breech slide (8).

In the instances of a firearm (13) which does not have a firing pin stop (21), a finger tab (17) may be attached to the rod (2) at rod slot (19) by set screw (18). The breech slide (8) has a cooperatively located breech slot (20) to allow the sliding of the finger tab (17) to move the rod (2). This configuration allows movement of the rod (2) as well as preventing the rod (2) from exiting the breech slide (8).

The chamber pin (4) slides in a pin cavity (15) such that the chamber pin (4) may been pushed out of the breech slide (8) and into the chamber (14). However, the chamber pin (4) is normally retained in the pin cavity (15) by the action of the spring (7) on the rod (2). Thus the operation of the firearm (13) in loading and unloading a cartridge (16) does not involve or cause cartridge (16) contact with the cartridge indicator (1). This feature provides for the cartridge indicator (1) not interfering with the firearm (1) operation and experiencing less wear as a result of operation.

To check for the presence of a cartridge (16) in the chamber (14) without the necessity to open the breech, the check end (3) of the cartridge indicator (1) is pushed into the breech slide (8) by the user or the finger tab (17) is engaged. If the chamber pin (4) encounters a cartridge (16), the check end (3) can not be pushed an appreciable distance. However, if the chamber (14) is empty the chamber pin (4) is free to be pushed into the chamber (14) thereby allowing the check end (3) to be pushed into the breech slide (8) to indicate an empty chamber (14).

I claim:

1. A device to check for the presence of a cartridge in a chamber of a firearm comprising:

a rod slidably mounted in a firearm in a breech block having a cavity defined therein;

a chamber end of the rod having a spring cavity defined therein with a spring mounted therein oriented to bias the rod away from a chamber of the firearm;

a check end of the rod protruding out of the breech block and having a shape to prevent the rod from exiting the breech block; and a chamber pin attached to the chamber end of the rod and extending into the breech block having a pin cavity defined therein which is in communication with the chamber.

2. The device as in claim 1 wherein the check pin does not protrude into the chamber when the spring is extended.

3. The device as in claim 1 wherein the cavity is generally oriented approximately parallel to the longitudinal axis of a barrel of the firearm and is formed adjacent to a striker of the firearm.

4. The device as in claim 1 wherein the check end having a flattened side shape to prevent the rod from exiting the breech block.

5. The device as in claim 1 wherein the check end has a tab.

6. The device as in claim 1 wherein the breech block having a breech slot with a finger tab slidably mounted therein and the finger tab attached to the rod having a rod slot defined therein.

* * * * *